US007669605B2

(12) United States Patent
Cho

(10) Patent No.: US 7,669,605 B2
(45) Date of Patent: Mar. 2, 2010

(54) HEATED EYELASH CURLER WITH COVER SWITCH

(76) Inventor: Yong Hoon Cho, 604 Murfield Ct., Fullerton, CA (US) 92835

( * ) Notice: Subject to any disclaimer, the term of this patent is extended or adjusted under 35 U.S.C. 154(b) by 914 days.

(21) Appl. No.: 11/355,738

(22) Filed: Feb. 16, 2006

(65) Prior Publication Data

US 2007/0186947 A1 Aug. 16, 2007

(51) Int. Cl.
*A45D 2/48* (2006.01)

(52) U.S. Cl. ..... 132/217

(58) Field of Classification Search ..... 132/217, 132/216, 218

See application file for complete search history.

(56) References Cited

U.S. PATENT DOCUMENTS 4,538,630 A * 9/1985 Henderson ..... 132/229
5,775,344 A * 7/1998 Clay ..... 132/218
5,853,010 A * 12/1998 Suh ..... 132/217
2004/0096258 A1* 5/2004 Kim ..... 401/1

FOREIGN PATENT DOCUMENTS

GB 2174896 A * 11/1986

* cited by examiner

*Primary Examiner*—Robyn Doan
(74) *Attorney, Agent, or Firm*—Maria Erlinda Co Sarno

(57) ABSTRACT

A heated eyelash curler comprising a curling head having a heating element, a cover switch engaged with the heated eyelash curler, and a body enclosing operational components of the heated eyelash curler connected to the curling head. The cover switch turns the heating element "on" after exposing the curling head and turns the heating element "off" after covering the curling head instead of the current practice of manually turning the switch "on" and "off". The engagement between the parts on the cover switch and the heated eyelash curler attaches the cover switch to the body of the heated eyelash curler. The heating element on the eyelash curler can be conventional or it can adopt wiring in a zigzag configuration housed within a conducting tube coated with a non-sticking material.

19 Claims, 8 Drawing Sheets

HEATED EYELASH CURLER WITH COVER SWITCH

This invention relates to a heated eyelash curler with a new switching system.

BACKGROUND

Most eyelash curler shape the eyelashes by manually pressing the eyelashes between two pinching elements, mostly arched to conform with the shape of the eyelids. U.S. Pat. No. 6,230,715 proposed the incorporation of a heating element into the pinching elements to hasten the curling process as well as result into a longer lasting curl. This invention can adopt all the features of the eyelash curler invented by the same inventor and disclosed in the U.S. patent application Ser. No. 10/885,426 filed Jul. 7, 2004. As in the cited application, the device can have different heating systems, one controlling the temperature by an "on" and "off" switch while the other heating system maintains the temperature when the desired temperature is reached. This application can also include the pigmented silicone piece and the light emitting diode (LED) of the said cited patent application and can also incorporate a mechanism wherein the red and green LED rapidly turn "on" and "off" repeatedly when the power source is low such as when the charge on the battery is low. The claimed device herein can also adopt the converter and the heating element comprising a conducting coil or wire inserted in a conducting tube as disclosed.

A major difference of the heated eyelash curler herein is the use of the cap covering the device as the switch to turn the power "on" or "off" instead of manually turning the switch. This is done through a switch knob that can be made to traverse a knob rail incorporated on the cap. This mechanism can be adopted to any eyelash curler other than the one cited herein. The power is turned "off" when the cap covers the curling head before use and the power is turned "on" when the cap exposes the curling head ready for the operation and is turned "off" again when the cap covers the curling head again after usage. The cap adopting this special feature and function is referred herein as the cover switch.

It is an object of this invention to provide a cover that can be used to turn the power "on" or "off" instead of manually reaching for the switch.

It is also an object of this invention to provide a heated eyelash curler having a cap or cover switch that has the safety feature of immediately protecting a person from burns by turning the power "off" as soon as the cap covers the heated section of the eyelash curler.

It is also another object of this invention to show how a switch knob can be used in conjunction with a knob rail to turn the heat "on" when the eyelash curler's curling head is exposed and turn the heat "off" when the curling head is covered.

It is a further object of this invention to provide a mechanism for turning the power "off" and "on" of any eyelash curler having a heating section that can be covered by a cap.

It is also a further object of this invention to show how a cover switch of this invention can be adopted to the heated eyelash curler disclosed in the U.S. patent application Ser. No. 10/885,426 filed Jul. 7, 2004 which discloses a curling head having a heating element surrounded by a shield to prevent skin burns, an indicator that directly touches the surface of the heating element for more accurate indication of the temperature on the curling head in addition to the LED indicators that are voltage driven, and a converter for achieving the desired curling temperature at a faster rate.

SUMMARY OF THE INVENTION

The invention relates to a heated eyelash curler, comprising a curling head having a heating element; a cover switch engaged with the heated eyelash curler, the cover switch turning the heating element "on" after exposing the curling head and turning the heating element "off" after covering the curling head; and, a body enclosing operational components of the heated eyelash curler connected to the curling head. There are several means for engaging the cover switch to the body of the heated eyelash curler as well as several methods for heating the heating element of the eyelash curler. In the example shown, the body of the heated eyelash curler includes a switch knob and an on/off switch which has a toggle enclosed within the switch knob, the switch knob therefore controlling the motion of the toggle. The curling head has a head piece with an arcuate top to cause an upward curl after repeated strokes of the eyelashes on the heating element. The arcuate top has a slit running along the head piece where the heating element is laid. The heated eyelash curler is recommended to have a temperature indicator such as a light emitting diode that lights up at a certain temperature or a silicone piece, having a pigment which changes color with temperature, situated close or at the heating element to prevent the user's eyelashes from burning. The temperature on the heating element can be controlled, that is maintained at a certain desired temperature.

The mechanism of using the cover or cap as a cover switch for turning the power on the heating element, "on" or "off", lies on the relationship between the knob rail on the cover switch and the switch knob on the heated eyelash curler. In an example, the switch knob protrude from the body of the heated eyelash curler and engages with the knob rail on the cover switch allowing the switch knob to traverse along opposite ends of the knob rail. The cover switch turns the power "on" or "off" as the switch knob traverse the knob rail from one end to another end. The power is "off" when the head of a location spring at an inside surface of the cover switch lodges on a first notch and the power is turned "on" when the head of a location spring at an inside surface of the cover switch lodges on a second notch. The body of the heated eyelash curler includes a compartment at its outside surface to house the locator spring. The head of the locator spring is recommended to be circular but any shape that will allow lodging and dislodging from the notches can be used. The notches conform with the shape of the locator spring head. The cover switch can have a top over cap and a bottom over cap engaged together by a clamp with a lamp cover for viewing a light emitting temperature indicator. The lamp cover can be at the top or the bottom over cap. The operational components of the heated eyelash curler is encased usually with an upper case and a bottom case joined or snapped together.

A method for using the above heated eyelash curler having a cover switch attached to the heated eyelash curler body turning the heating element "on" after exposing the curling head and turning the heating element "off" after covering the curling head, comprises: moving the cover switch along the body of the heated eyelash curler to expose the curling head; curling a user's eyelashes by stroking the eyelashes on the heating element; and, moving the cover switch along the body of the heated eyelash curler to cover the curling head and turn the heating "off" on the heating element. In one example, the eyelashes are introduced at spaces between the bridges encasing the heating element to prevent the eyelashes from burning with the bridges guiding the eyelashes at these get curled.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWING

Aspects of the present invention are illustrated by way of example, and not by way of limitation, in the accompanying drawings, wherein.

DETAILED DESCRIPTION OF THE INVENTION

Figure 1A:
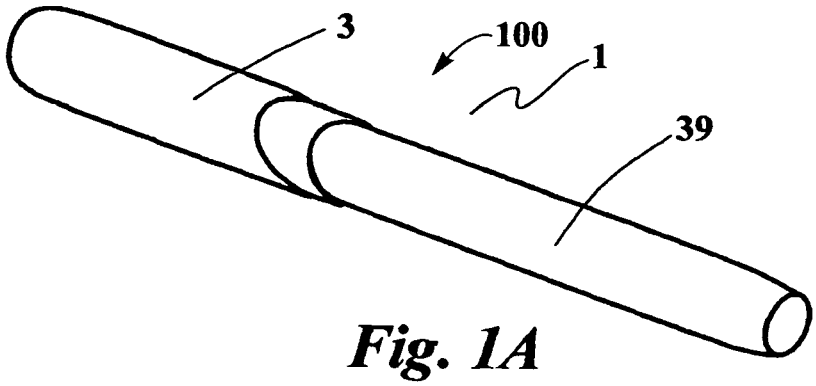
FIG. 1A is a perspective view of a heated eyelash curler having a cover switch on the "off" position.
Figure 1B:
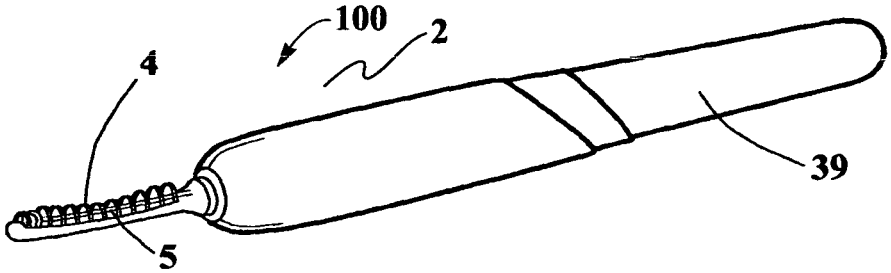
FIG. 1B is perspective view of a heated eyelash curler having a cover switch on the "on" position.
Figure 2:
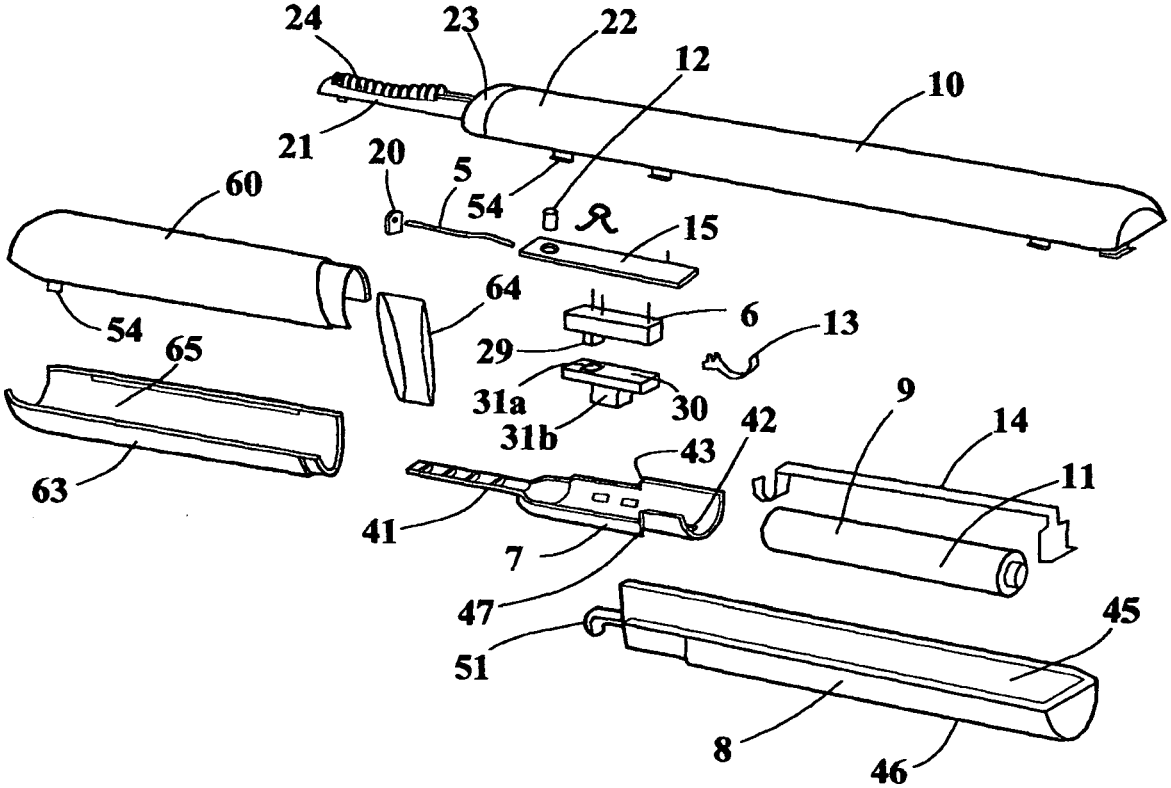
FIG. 2 a perspective view of the major components of an example of a heated eyelash curler adopting the cover switch.
Figure 3A:
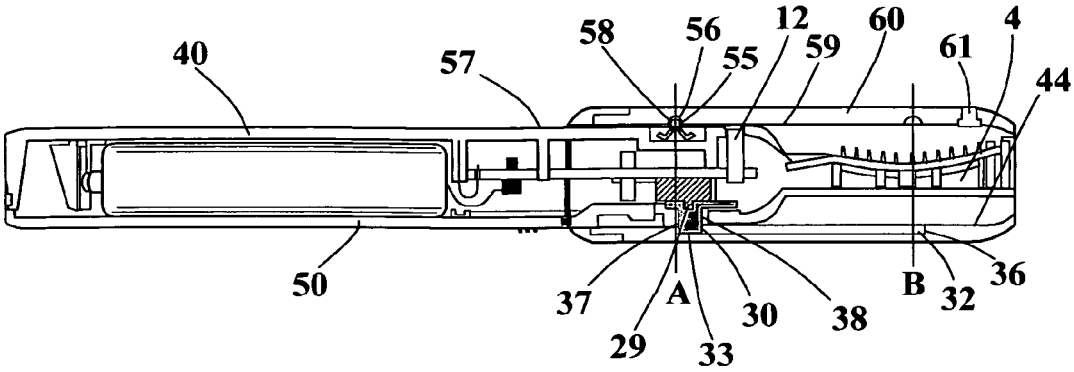
FIG. 3A is a cross sectional view of an assembled heated eyelash curler shown in FIG. 2 in the "off" position.
Figure 3B:
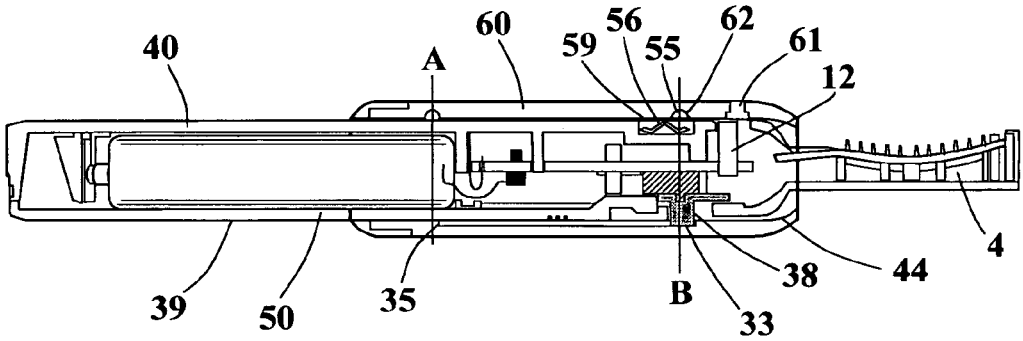
FIG. 3B is a cross sectional view of an assembled heated eyelash curler shown in FIG. 2 in the "off" position just before the cover switch turns the heated eyelash curler in the "on" position.
Figure 3C:
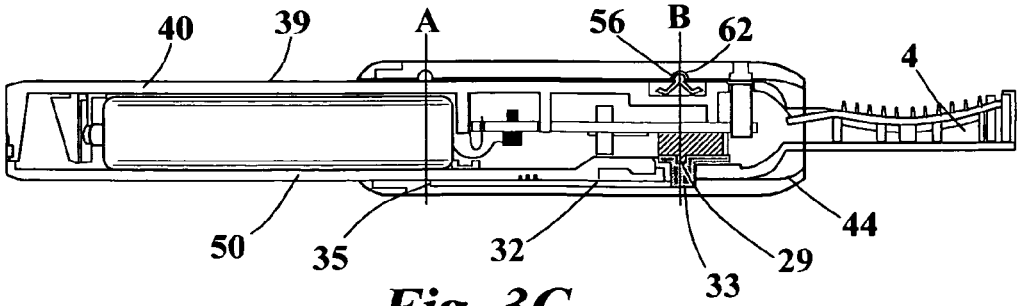
FIG. 3C is a cross sectional view of an assembled heated eyelash curler shown in FIG. 2 in the "on" position.

FIGS. 1A and 1B show perspective views of an example of a heated eyelash curler employing a cover switch 100 in the "off" position 1 and in the "on" position 2, respectively. FIG. 2 shows the parts or components of an example of a heated eyelash curler having the cover switch 100 and FIGS. 3A-3C show how these parts are assembled which would be used to illustrate the claimed invention. The heated eyelash curler in the example shown in FIGS. 1,2 and 3A-3C includes the cap 3, a curling head 4 having a heating element 5, an electrical circuit for heating the curler connected to an on/off switch 6, a frontal bottom case 7 for the circuitry, a lid 8 for the power source 9 and an upper case 10 for covering the frontal bottom case 7 and the lid 8 for the power source herein shown as a battery 11.

Figure 4A:
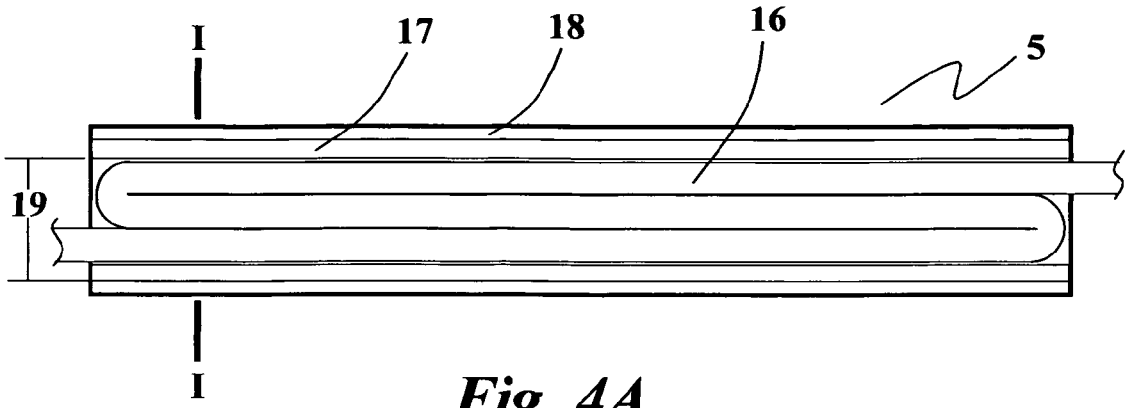
FIG. 4A is a cross sectional view of the heating element showing the zigzag arrangement of the heating coil inside a conducting tube.
Figure 4B:
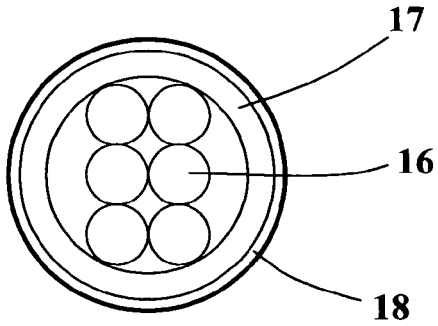
FIG. 4B is a cross sectional view of the zigzag arrangement along I-I of the heating coil inside the conducting tube shown in FIG. 4A.

The lamp or LED indicator 12, the on/off switch 6, the negative 13 and the positive 14 terminal for the power source 9, herein shown as the battery 11 are all soldered to a plate 15 which is a circuit board housing the electrical circuitry controlling the temperature of the heating element 5 and the LED indicator/s 12. The heating element 5 is connected to the circuitry on the circuit board and comprises a conducting coil or wire 16 which is recommended to be designed as shown in FIGS. 4A and 4B as lined in zigzag configuration along the length of the heating element 5. Other types of conducting coil or wire can be used. The conducting coil or wire 16 is usually made from chromium and nickel. The proposed zigzag configuration maximizes the generation of heat and allows the temperature to rise up at a faster rate as well as keep the heating process regular, that is, not fluctuating and evenly distributed throughout the heating element due the increased surface area resulting from the zigzag configuration of the conducting coil or wire, thereby enabling the user to curl the eyelashes quickly and consequently, allowing the battery to last longer. The zigzag coil or wire 16 is recommended to be placed inside a conducting tube 17 such as a brass tubing which is in turn coated with a non-sticking material 18 such as teflon on its outside surface to keep the eyelash from directly contacting and sticking on the brass tubing which can cause burning of the eyelashes. The length of the conducting tube 17 or brass tubing dictates the length of the heating element 5. The number of zigzag turns is usually limited by the diameter of the coil or wire 16 and the diameter of the conducting tube 19. Near the tip of the heating element 5 is introduced a silicone piece 20, preferably shaped like a ring for easy introduction into and around the heating element 5. Direct contact between the silicone piece and the heating element provides a more reliable method for detecting the temperature because the silicone piece contains a pigment that changes its color with temperature. This pigmented silicone material can be purchased from Zhejiang Xinan Chemical Industrial Group Co., Ltd. having a website: www.xinanchem.com. At room temperature, the color of the chosen pigmented silicon piece is purple. The purple color gradually changes to opaque white or colorless as the temperature of the heating element rises. When the heating element is at the desired temperature, for example between 60-70 degrees Centigrade, the color of the chosen pigmented silicone piece is opaque white or colorless. The user is notified that the eyelash curler is heated when the silicone piece has lost its purple color. The positive 14 and the negative 13 terminals connect to the circuit board at the side opposite the heating element 5 which provides connection to the charged terminals of the power source, herein as example, a battery 11 when this is placed in between the terminals 13 and 14. Here, the terminals are coaxial to make good contact with the charged ends of the battery. Those skilled in the art can easily modify the electrical connections to be able to use any power source 9 aside from a battery.

Figure 5:
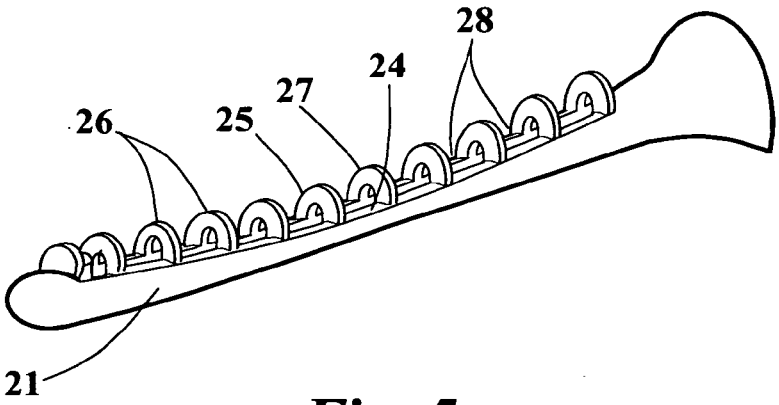
FIG. 5 is a perspective enlarged view of the curling head of the heated eyelash curler without the heating element showing in more detail, the protective shield, the openings on the bridges and the slit underneath the bridges.
Figure 6:
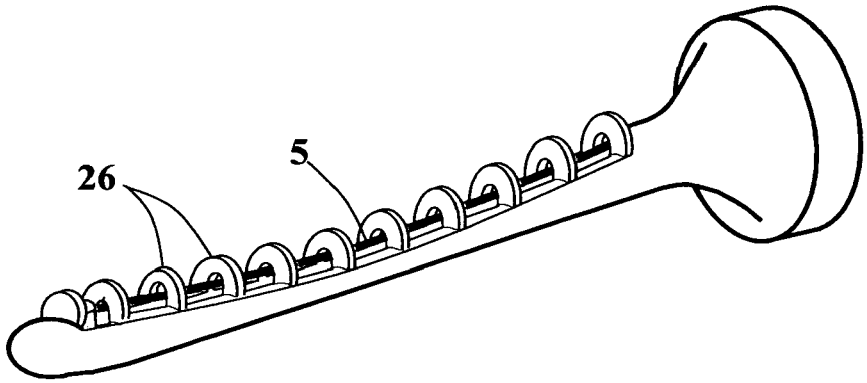
FIG. 6 is a perspective view of the curling head of the heated eyelash curler of FIG. 5 with the heating element.

The upper case 10 covers the half top section of the eyelash curler without the cap 3 or the cover switch 100. The upper case includes a head piece 21 at the front end connected to a half cylindrical shaped body 22 with a rounded recessed neck 23 at the junction where the head piece and the half cylindrical body attaches to each other. The head piece has an arcuate top surface 24 shaped to cause an upward curl after several repeated strokes of the eyelashes on the heating element 5. The arcuate top surface 24 has a slit 25 running horizontally along the head piece 21 where the heating element 5 is introduced to lay above the slit 25. Along the arcuate top surface 24, at the location where the heating element 5 will sit, are a plurality of small bridges 26 running perpendicular from the slit 25. As shown in FIGS. 1, 2, 3A-3C and 5, the bridges 26 protrude from the arcuate top surface 24 to result in a space 27 beneath the bridges, between the arcuate top surface 24 and the bridges 26. The heating element 5 situates in this space 27 resulting in the heating element being caged by the bridges 26 as shown in FIG. 6. The heating element 5 is introduced into the upper casing 10 by squeezing the heating element 5 into the slit 25, to situate on the space 27 underneath the bridges 26 as shown in FIGS. 5 and 6. Since the bridges protrude from the arcuate top surface 24, the bridges prevent the skin from directly contacting the heating element 5 but allow the eyelashes direct contact for optimum curling. The bridges 26 also serves as a guide for the eyelashes, just like a comb, because the eyelashes enter at the intervals or spaces 28 between the bridges. Vertically protruding blunt or round ended comblike spikes, similar to the teeth of a comb or brush, may be incorporated to line horizontally along the ends of the bridges for added protection from burns and to assist in guiding the eyelashes. These comblike projections may also substitute for the bridges, with the heating element placed between two rows of the comblike projections, if desired.

Figure 7:
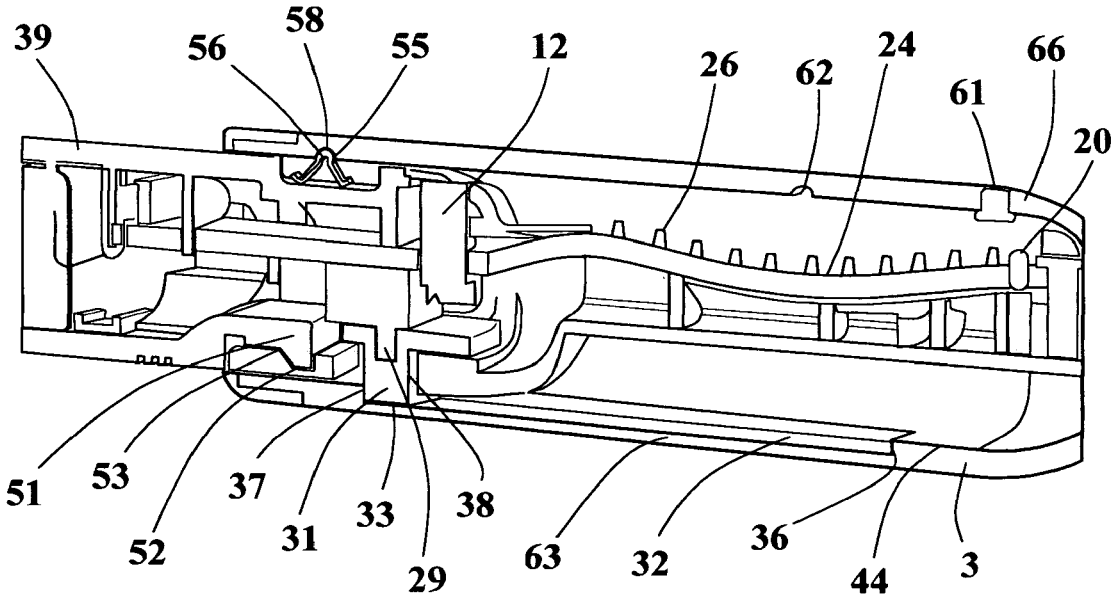
FIG. 7 is a blown up portion of FIG. 3A showing details of the relation of the cover switch in the "off" position with the heated eyelash curler.
Figure 8A:
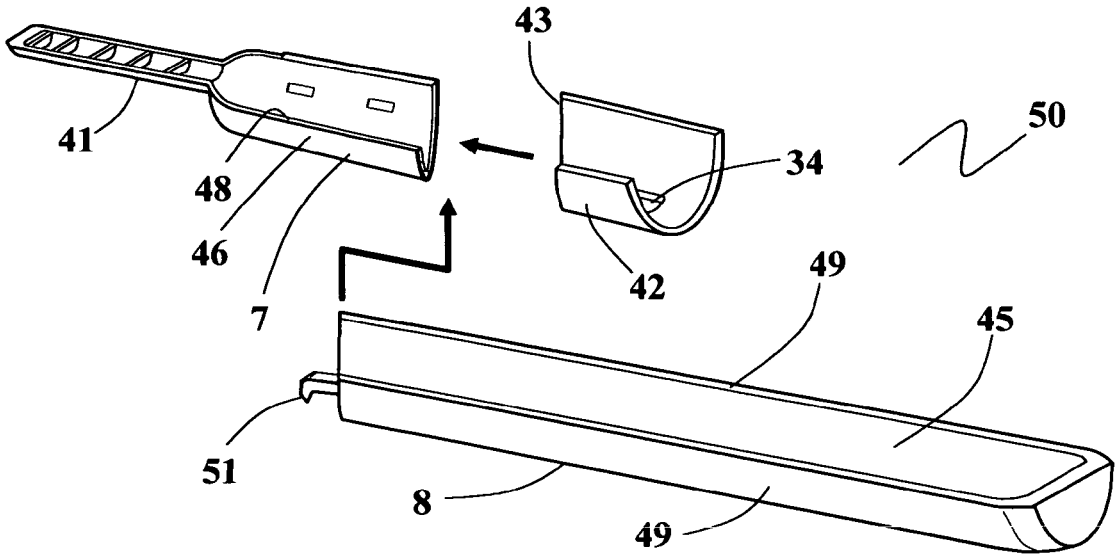
FIG. 8A is an exploded view of the bottom case of the heated eyelash curler showing the three segments.
Figure 8B:
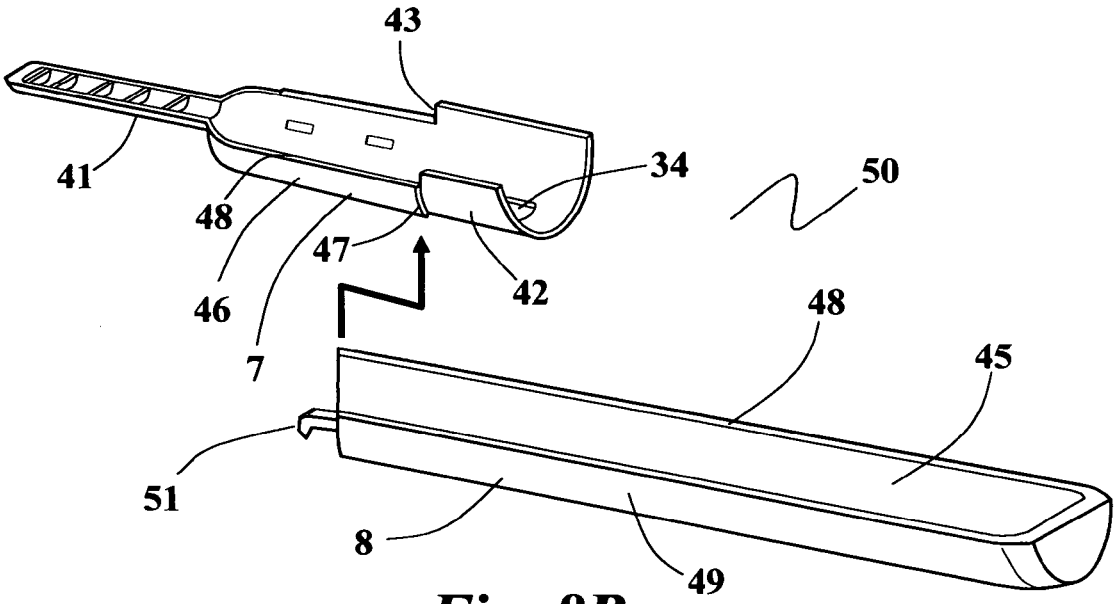
FIG. 8B is a perspective view of the two segments of the bottom case with the lid for the power source detached.
Figure 8C:
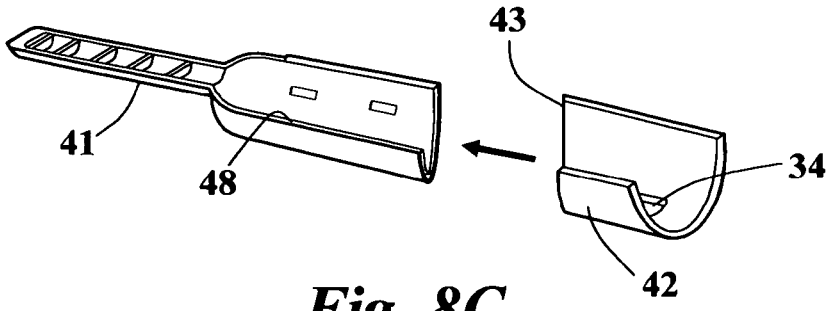
FIG. 8C is a perspective view of the frontal bottom face with the frontal segment detached from the second segment.

The on/off switch 6 is installed or soldered on the circuit board 15 with the toggle 29 facing downwards towards the bottom case 50. A switch knob 30 encloses the toggle 29 of the on/off switch 6 on one end 31*a* facing the upper case 10 with the opposite usually rectangular or square end 31*b* situating on the knob rail 32, a longitudinal horizontally oriented etching on the inside surface of the cap 3 or cover switch 100 to accommodate the top 33 of the switch knob end 31*b* as it traverse the knob rail 32 as shown in FIGS. 3A-3C and 7. The top 33 of the switch knob end 31*b* protrudes from an opening 34 at the frontal bottom case 7 as shown in FIGS. 8A and 8B. The side ends 35, 36 of the knob rail 32 act as a stopper for the switch knob when the side edge 37 of the switch knob 30 touches on one end 35 of the knob rail 32 as shown in FIG. 3A or when the side edge 38 of the switch knob touches on an opposite end 36 of the knob rail as shown in FIG. 3C. The switch knob 30 enclosing and thereby controlling the motion of the toggle 29 plays a major role on the claimed switching mechanism brought about by the cover switch 100 turning the power "on" when the cover switch moves laterally along the body 39 of the heated eyelash curler to expose the curling head 4 and turning the power "off" when the cover switch moves laterally along the body 39 of the heated eyelash curler to cover and house the curling head 4 within the cover switch 100.

The bottom case 50 is designed to match and attach to the upper case 10 to enclose the operational components of the eyelash curler especially the electrical circuitry between the upper and lower case and together with the uppercase, serve as the body 39 of the eyelash curler. There are many known means of attaching these cases together such as snapping, bonding, clamping, etc. The bottom case 50 in this design comprises three segments. The frontal segment 41 covers the curling piece 21 of the upper case which together forms the curling head 4 and may extend to the lamp or indicator 12. This segment matches the front section of the uppercase 10 to the point covered by the front segment of the bottom case. A second segment 42 connects to the frontal segment 41 at one lateral end 43 of the second segment and as shown in FIGS. 2, 8A and 8B, is likewise half cylindrical but of a smaller diameter than the frontal segment 41 and is recessed from the frontal segment. The frontal segment and the second segment together forms the frontal bottom case 7 while the frontal segment, second segment and the lid forms the bottom case 50. The opening 34 is etched out at this second segment to allow the switch knob 30 to protrude from this section and traverse the knob rail located, as shown in this example, at the inside surface 44 of the cover switch as shown in FIG. 7. The top end of the second segment, being of a smaller diameter, results in a lateral protrusion 47 equivalent to the thickness 48 of the wall 46 of the power source or wall 49 of the battery lid 8, thereby fitting into the internal side 45 of the wall 49 of the lid 8. The power source lid 8 is the third segment of the bottom case 50. This lid covers the power source and is necessarily detachable to enable one to change the battery as needed. This lid 8 is also half cylindrical and matches the diameter of the upper case 10. In use, this lid covers both the second segment 42 and the power source and when it covers these, the lid 8 and the upper case 10 serves as the handle 40 for the body 39 of the eyelash curler. The lid 8 attaches to the frontal bottom case 7 and consequently, to the upper case 10 by a hook 51 located on one end of the lid inserting into a matching groove 52 which can be placed either at the inside walls of the frontal segment, the second segment or the cover switch. FIG. 7 shows the groove 52 at the inside wall or inside surface 44 of the cover switch. It is recommended for the groove to have a slanted wall 53 at the point of engagement with the hook to allow the hook 51 to engage and disengage without applying so much force as to destroy the hook. After the hook is in place, the upper case can be attached to the bottom case with or without the use of clips 54.

The design of the cover switch 100 and the switching mechanism of the cover switch can be best understood by following in a step-wise fashion, the illustration shown in FIGS. 3A-3C. FIG. 3A shows the heated eyelash curler in the "off" position, the cover switch covering the curling head 4. Here, a location spring 55 shown here with a circular head 56 resting on a compartment at the outside surface 57 of the upper case 10 lodges its circular head 56 at a first circular notch 58 located at the inside surface 59 of the top over cap 60 of the cover switch 100. The head of the location spring need not be circular as long as it can easily lodge and dislodge from the notch when the cover switch moves along the body 39 of the heated eyelash curler. When the locator spring 55 is at this "off" position, the side edge 37 of the switch knob 30 touches end 35 of the knob rail 32. Note that at this position, the lamp cover 61 located or placed also on the top over cap 60 of the cover switch is very far from the position of the lamp or indicator 12. The "off" position is shown by line A when the circular head 56 is at the first circular notch 58. To turn the power from the "off" position to the "on" position, the cover switch is moved towards the handle 40 along the body 39 to expose the curling head 4 which moves the location spring 55 towards line B. FIG. 3B shows the heated eyelash curler still on the "off" position but at a position just before the switch knob 30 turns the switch 6 to the "on" position. Here, the circular head 56 along with the rest of the location spring 55 is flattened by the inside surface 59 of the top over cap 60. The circular head 56 is at the position just outside the second circular notch 62. Notch 62 is at position B. In this position, the toggle 29 of the on/off switch 6 is still in the "off" position even if the side edge 38 of the switch knob already touches end 36 of the knob rail, which in this case is opposite end 35. Note that at this position, the lamp cover 61 is very close to the position of the lamp or indicator 12. FIG. 3C shows the heated eyelash curler in the "on" position. Here, with additional push on the cover switch towards the handle 40, the circular head 56 of the location spring 55 lodges on the second circular notch 62, and without changing the position of the switch knob 30 on the knob rail 32, the additional push causes the toggle 29 on the on/off switch 6 to turn to the "on" position. Note the change in position of the toggle 29 and consequently, the position of the on/off switch 6 relative to the switch knob 30. Line B shows the position when the heated eyelash curler is turned "on". Here, the lamp or indicator 12 is directly below the lamp cover 61.

The preceding paragraph facilitates the description of the construction of the cover switch 100. The cover switch comprises a top over cap 60 and a bottom over cap 63 which are engaged together by a clamp 64 with or without the clips 54 for snap closing the over caps together once they are placed in the right position in relation with the body 39 of the heated eyelash curler. Internally, on the inside surface of the top over cap 60 are the notches 58 and 62 to accommodate the circular head 56 of the location spring 55 when it is in the "off" or "on" position. At the inside surface 65 of the bottom over cap of the cover switch 100, is the knob rail 32 etched out longitudinally over a distance for the switch knob 30 to traverse from the "off" to the "on" position. The cap 3 forming the cover switch 100 engages with the body 39 of the heated eyelash curler through the location spring, the notches and the switch knob on the knob rail which prevents the cover switch from being disengaged from the body once the clamps are placed and the over caps snapped together. The cover switch and the body of the eyelash curler are typically made of hard sturdy plastic material such as acrylonitrile butadiene styrene and equivalents or of nonconducting metals such as aluminum. The terminals, coils, wire and the conducting case or tubing of the heating element are usually made of conducting materials such as the copper alloys. It is recommended to have a location spring made of stainless steel material.

Figure 9:
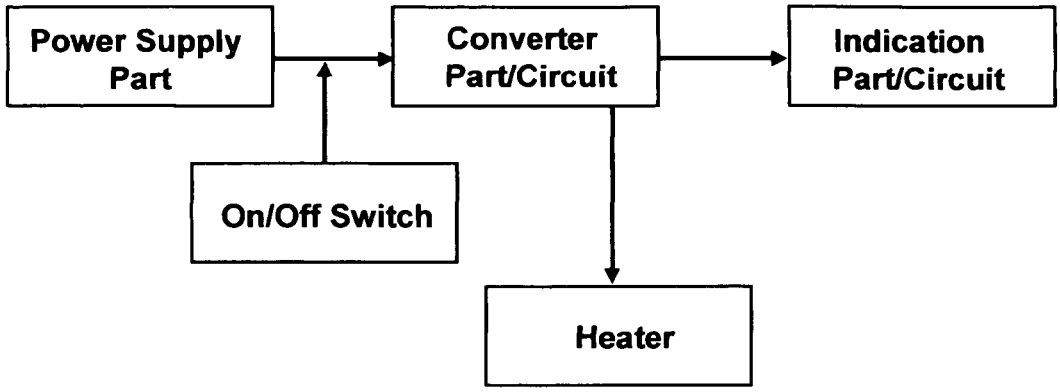
FIG. 9 is a block diagram of a heating mechanism having a heat control and an LED indicator for denoting on and off switching of the device.
Figure 10:
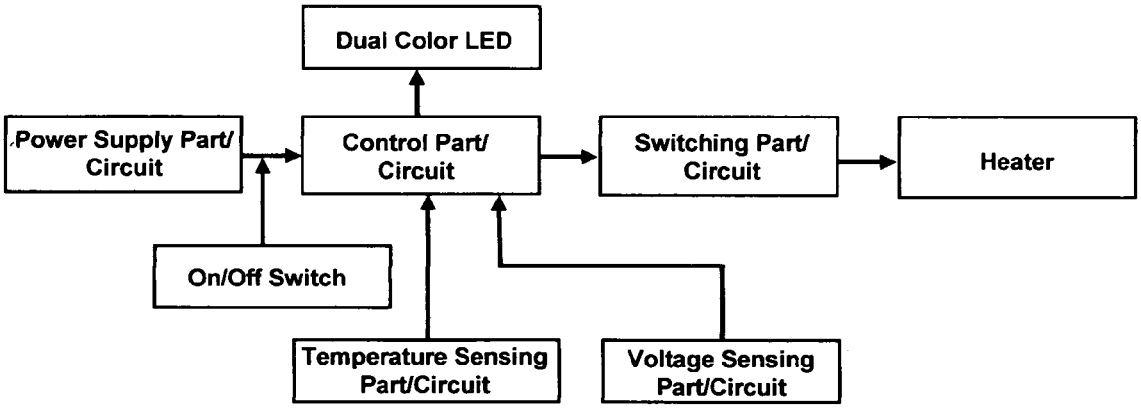
FIG. 10 is a block diagram of a heating mechanism having a heat control and LED indicators to show when the curling temperature is at its optimum.
Figure 9A:
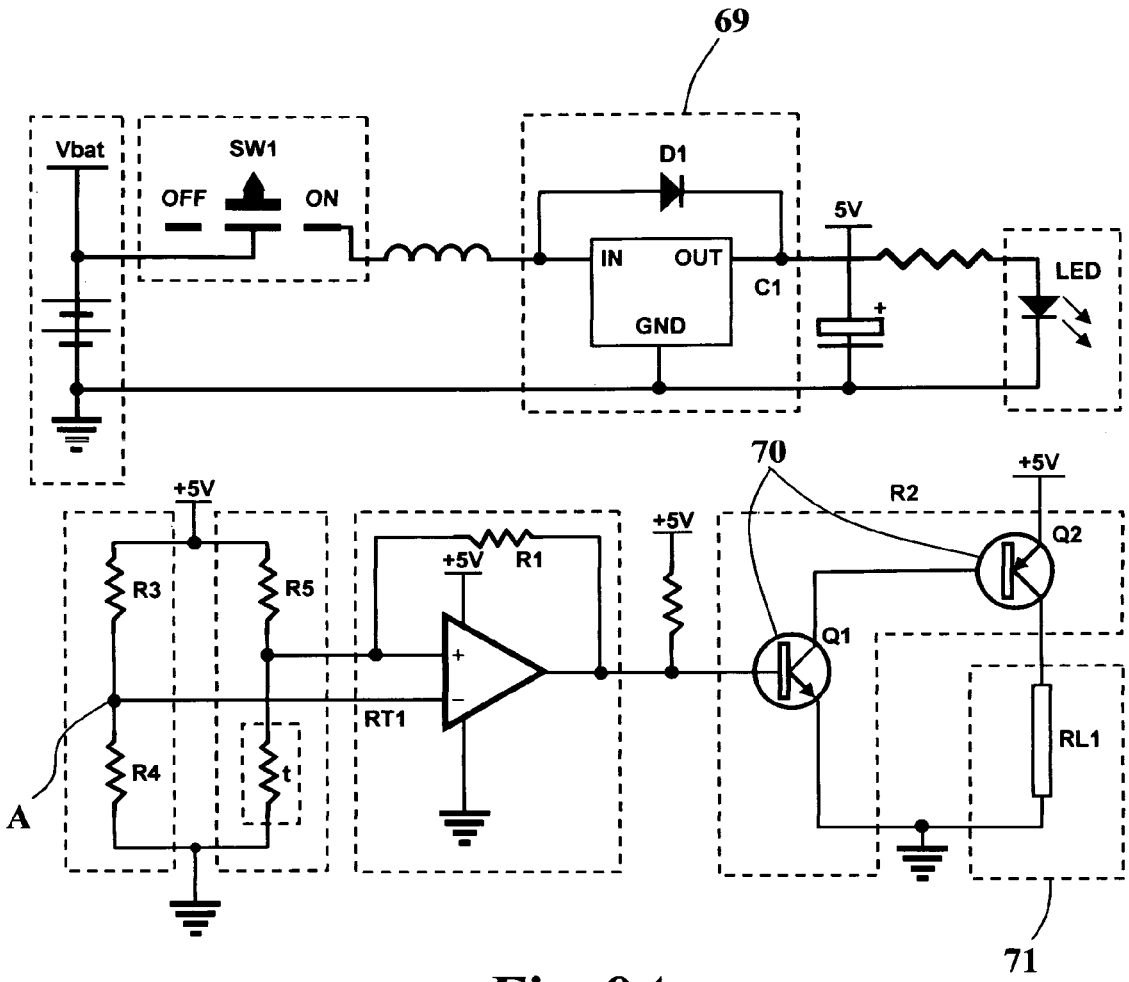
FIG. 9A is a circuit diagram of the heating mechanism shown in FIG. 9.
Figure 10A:
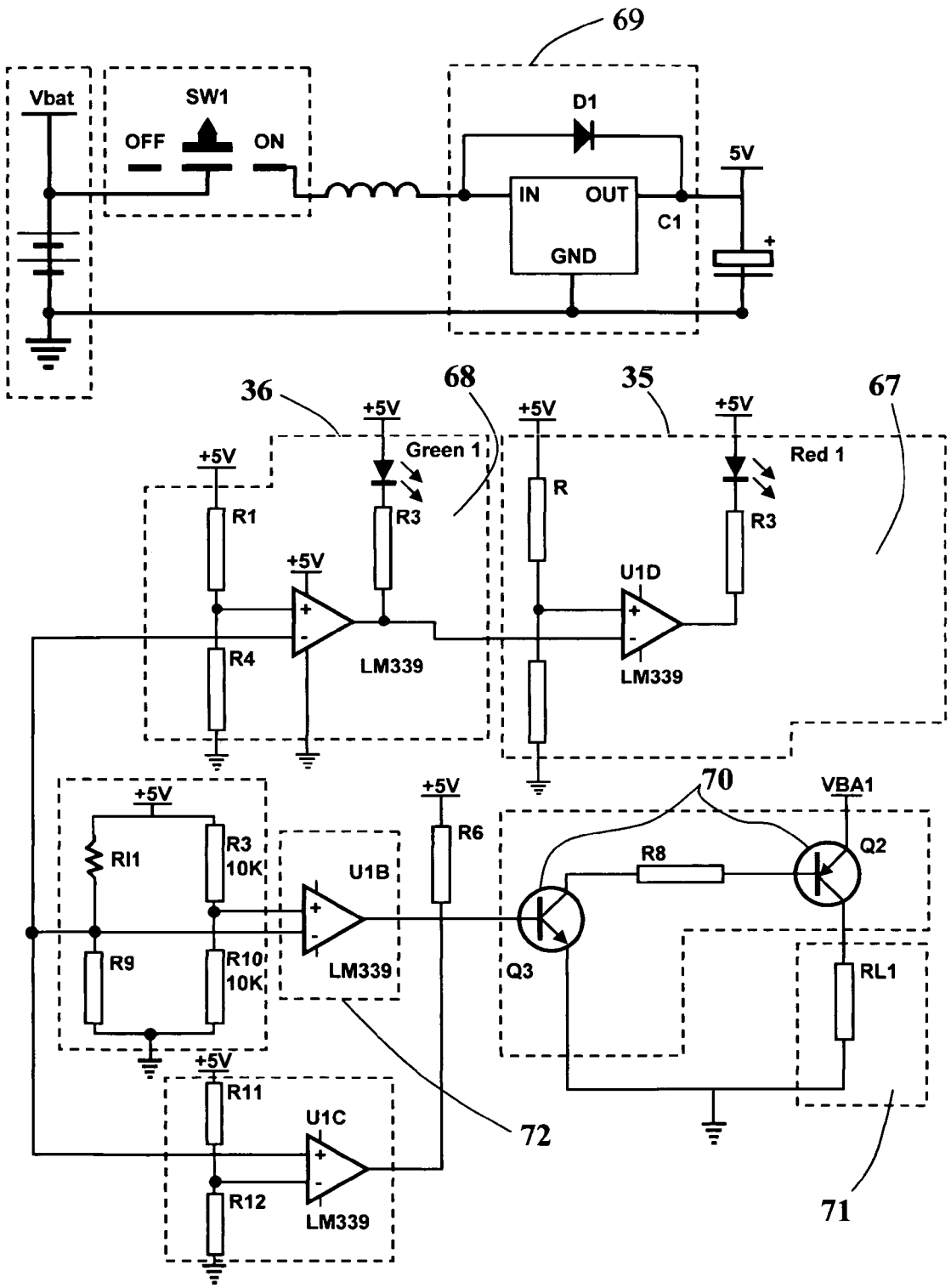
FIG. 10A is a circuit diagram of the heating mechanism shown in FIG. 10.

In this example, also on the top over cap of the cover switch 100, proximal to the front end 66 of the cover switch and notch 62 is a lamp or indicator cover 61 for viewing the light emitted by the lamp or indicator 12, such as a light emitting diode (LED) if the device will incorporate one. Whether the indicator cover 61 is on the top or bottom over cap depend upon the location of the lamp or indicator. For the eyelash curler without a temperature or heat control, when the switch is turned 'on', an LED indicator, if incorporated in the curler, turns "on" and the heating element gets its power directly from the power source. For this type of eyelash curler, the user should turn the switch "off" as soon as the curler reaches the desired temperature or when the eyelashes are curled. The time to switch the power "on" or "off" can be conveniently noted by the color on the silicone piece 20. With this circuitry, there may be a need to turn the switch "on" and "off" several times to prevent overheating. For temperature controlled curlers, however, the user does not have to worry about the curler getting overheated. The circuit shown on FIGS. 9 and 9A show the heating process with a temperature control and FIGS. 10 and 10A show the heating process, additionally incorporating two indicators instead of one, for example, one LED indicator 67 turning red when the heating element 5 is heated but below the desired temperature and another LED indicator 68 turning green when the heating element is at the desired temperature. At least one indicator, together with the silicone piece 20 provide a better safeguard for the user. Optionally, in order to avoid the disappointment of having a nonoperational eyelash curler when needed, the LED indicator/s can be wired to emit a flickering light when the power coming from the battery is low, indicating the need of replacement. In the heating mechanisms shown in FIGS. 9, 9A, 10 and 10A, a converter 69 boosts the voltage coming from a power source, for example, 2.4 volts from a battery to that required by the device to quickly curl the eyelashes which is approximately 5 volts. Current heating mechanisms for eyelash curlers do not have the converter, relying solely from the voltage output of the battery. Consequently, the rate of heating is slow and the achieved temperature may be lower than desired. This converter 69 in a battery heated eyelash curler together with the zigzag configuration of the conducting coil or wire 16 makes the heating mechanism of this claimed eyelash curler superior in performance. The transistors 70 adjust the voltage according to the temperature of the heater 71 to limit the amount of the electric current sent to the heater and therefore maintain a constant temperature. The design shown in FIGS. 10 and 10A adds a voltage comparator 72 which compare the signals from the temperature and/or voltage sensors and optically represent the heater status on a two LED indicator system and/or the charged condition of the power source which constitute part of the heating mechanisms shown in FIGS. 10 and 10A.

To use the curler, one simply move the cover switch 100 to the "on" position, exposing the curling head 4 and let the eyelashes enter the spaces 28 between the bridges 26 and/or comblike projections until the eyelashes touches on the heating element 5. The eyelashes curl after a few repeated upward strokes against the heating element 5 when the latter is at the desired temperature. Unlike conventional curlers, this does not require the eyelashes to situate between two pinching or forming elements, requiring manual dexterity and experience. After use, the cover switch 100 is simply moved to the "off" position, concealing or covering the curling head 4 inside the cover switch to cool.

While the embodiments of the present invention have been described, it should be understood that various changes, adaptations, and modifications may be made therein without departing from the spirit of the invention and the scope of the claims.

I claim:

1. A heated eyelash curler, comprising:

a curling head having a heating element;

a cover switch engaged with the heated eyelash curler, the cover switch turning the heating element "on" when the cover switch exposes the curling head and turning the heating element "off" when the cover switch covers the curling head;

a body enclosing operational components of the heated eyelash curler connected to the curling head;

means for engaging the cover switch to the body of the heated eyelash curler; and, means for heating the heating element of the eyelash curler.

2. The heated eyelash curler of claim 1 wherein the body of the heated eyelash curler includes a switch knob and an on/off switch.

3. The heated eyelash curler of claim 2 wherein the on/off switch has a toggle enclosed within the switch knob, the switch knob thereby controlling the motion of the toggle.

4. The heated eyelash curler of claim 2 wherein the switch knob protrude from the body of the heated eyelash curler.

5. The heated eyelash curler of claim 1 wherein the curling head has a head piece having an arcuate top to cause an upward curl after repeated strokes of the eyelashes.

6. The heated eyelash curler of claim 5 wherein the arcuate top has a slit running along the head piece where the heating element is laid.

7. The heated eyelash curler of claim 1 further comprising a temperature indicator.

8. The heated eyelash curler of claim 7 wherein the temperature indicator is a light emitting diode.

9. The heated eyelash curler of claim 7 wherein the temperature indicator is a silicone piece containing a pigment that changes its color with temperature.

10. The heated eyelash curler of claim 1 further comprising a temperature controller for the heating element.

11. The heated eyelash curler of claim 1 wherein the cover switch includes a knob rail engaging with a switch knob on the heated eyelash curler allowing the switch knob to traverse along opposite ends of the knob rail.

12. The heated eyelash curler of claim 1 wherein the body comprises an upper case and a bottom case.

13. The heated eyelash curler of claim 1 wherein the body of the heated eyelash curler includes a compartment at its outside surface housing a locator spring having a head.

14. The heated eyelash curler of claim 13 wherein the head of the location spring lodges on a first notch at an inside surface of the cover switch when the heated eyelash curler is in an "off" position and lodges on a second notch at the inside surface of the cover switch when the heated eyelash curler is in an "on" position as the switch knob traverse a knob rail from one end to another end.

15. The heated eyelash curler of claim 1 further comprising a lamp cover on the cover switch for viewing a light emitting temperature indicator.

16. The heated eyelash curler of claim 1 wherein the cover switch comprises a top over cap and a bottom over cap engaged together by a clamp.

17. A heated eyelash curler, comprising:

a curling head having a heating element attached to a body enclosing operational components of the heated eyelash, the body comprising a switch knob protruding from the body and an on/off switch having a toggle enclosed within the switch knob, the switch knob controlling the motion of the toggle;

a cover switch having a knob rail engaging with the switch knob of the heated eyelash curler, the cover switch turning the heating element "on" when the cover switch exposes the curling head and lodges a head of a location spring on a second notch at an inside cover of the cover switch and turning the heating element "off" when the cover switch covers the curling head and lodges the head of the location spring on a first notch at the inside cover of the cover switch as the switch knob traverse the knob rail from one end to another end;

means for engaging the cover switch to the body of the heated eyelash curler; and, means for heating the heating element of the eyelash curler.

18. A method for using a heated eyelash curler having a curling head with a heating element attached to a body enclosing operational components of the heated eyelash and a cover switch attached to the body having a knob rail engaged to a knob switch turning the heating element "on" after exposing the curling head and turning the heating element "off" after covering the curling head, comprising:

moving the cover switch along the body of the heated eyelash curler to expose the curling head;

curling a user's eyelashes by stroking the eyelashes on the heating element; and, moving the cover switch along the body of the heated eyelash curler to cover the curling head and turn the heating "off" on the heating element.

19. The method of claim 18 wherein the eyelashes are stroked on the heating element caged by bridges on the curling head.

* * * * *